US006083655A

United States Patent [19]

Itabashi et al.

[11] Patent Number: 6,083,655

[45] Date of Patent: Jul. 4, 2000

[54] MAGNETIC BRUSH DEVELOPING METHOD

[75] Inventors: Hitoshi Itabashi, Yokohama; Yuko Sato, Numazu; Yoshinobu Baba; Yuzo Tokunaga, both of Yokohama, all of Japan

[73] Assignee: Canon Kabushiki Kaisha, Tokyo, Japan

[21] Appl. No.: 09/353,840

[22] Filed: Jul. 15, 1999

[30] Foreign Application Priority Data

Jul. 15, 1998 [JP] Japan ..... 10-200723
Jul. 12, 1999 [JP] Japan ..... 11-197476

[51] Int. Cl.[7] ..... G03G 13/09
[52] U.S. Cl. ..... 430/122
[58] Field of Search ..... 430/122

[56] References Cited

U.S. PATENT DOCUMENTS

| | | | |
|---|---|---|---|
| 4,906,547 | 3/1990 | Tavernier et al. | 430/122 |
| 5,318,873 | 6/1994 | Kawamura et al. | 430/122 |
| 5,336,580 | 8/1994 | Tavernier et al. | 430/122 |
| 5,346,791 | 9/1994 | Ozawa et al. | 430/122 |
| 5,395,717 | 3/1995 | Ozawa et al. | 430/122 |
| 5,736,287 | 4/1998 | Kobayashi et al. | 430/122 |
| 6,010,811 | 3/2000 | Baba et al. | 430/122 |

FOREIGN PATENT DOCUMENTS

| | | | |
|---|---|---|---|
| 0331425 | 9/1989 | European Pat. Off. | 430/122 |

*Primary Examiner*—Roland Martin
*Attorney, Agent, or Firm*—Fitzpatrick, Cella, Harper & Scinto

[57] ABSTRACT

A developing method including the steps of: stirring a two component-type developer which contains a toner and a carrier; conveying the developer to a developing section with a conveying screw and a developer carrying member; and developing an electrostatic latent image on an image holding member by forming a magnetic brush on a developing magnetic pole, wherein the carrier is a magnetic material dispersion-type resin carrier containing a binder resin and a metal oxide, has a low coercive force and has been previously exposed and magnetized in a specific magnetic field and has stable residual magnetization, thereby imparting a high durability to the developer and making it usable for a long time to reproduce a large number of images having stable qualities.

19 Claims, 3 Drawing Sheets

STATE OF CARRIER AT THE BEGINNING OF COPY

STATE OF CARRIER AFTER CONTINUOUS COPY OF 1,000 SHEETS

STATE OF CARRIER AFTER CONTINUOUS COPY OF 10,000 SHEETS

MAGNETIC BRUSH DEVELOPING METHOD

BACKGROUND OF THE INVENTION

1. Field of the Invention

The present invention relates to a developing method to develop an electrostatic latent image with a two component-type developer which contains a magnetic material dispersion-type resin carrier for electrophotography.

2. Related Background Art

Glass beads, iron powder, ferrite powder and fine particles of magnetic material dispersion type resins are conventionally known as carriers which are to be used in combination with toners to develop electrostatic latent images in electrophotography, and it is general in these days to use a carrier which comprises iron powder, ferrite powder and fine particles of magnetic material dispersion-type resin due to demands for developing processes.

For a two component-type developing method which uses a two component-type developer comprising a carrier and a toner as described above, there has been proposed to weaken a magnetic force of the carrier as a technique to enhance qualities of copied images. This proposal is an attempt to form a finer and softer magnetic brush on a developer carrying member by weakening a magnetic force of the carrier, thereby making it possible to form a high fidelity image without splashes or scatters of the toner in developing an electrostatic latent image on a photosensitive drum with the developer. Furthermore, use of the carrier which has a weakened magnetic force lessens deterioration of the developer during developing operations repeated to reproduce a large number of, copies, thereby making it possible to obtain high quality images for a long time.

As methods to obtain a carrier which has a weakened magnetic force, there can be mentioned one which prepares a carrier as ferrite by mixing an iron oxide with a non magnetic metallic oxide which is an impurity and another which prepares a carrier by dispersing a magnetic powder in a binder resin. Magnetic material dispersion-type resin carriers which contain dispersed magnetic materials are preferable in particular since the magnetic forces and particle sizes can easily be controlled. For this reason, carriers having uniform and small particle sizes which are prepared by polymerization methods or the like are used in these days where there are demands for toners and carriers which have smaller particle sizes.

When development is repeated to reproduce a large number of copies using such a resin carrier as a developer, however, inconvenience is conventionally encountered that image densitys are lowered as the developer is used for a longer time. Furthermore, the developer poses another problem that fog is produced on non-image areas when a toner is repeatedly replenished to keep a toner content constant in the developer. Making elaborate examinations of this phenomenon, the inventors of the present invention found that a fluidity of the developer was remarkably lowered as development was repeated to reproduce a large number of copies and that a cause for the lowering of the fluidity lay in residual magnetization of the carrier which was increased as the developer was used. Though a magnetic material which has a weak coercive force is used as a component of the magnetic material dispersion-type resin carrier, it is considered that the resin carrier is gradually magnetized on a developer carrying member as development was repeated, thereby resulting in enhancement of residual magnetization and constituting a cause for the lowering of the fluidity of the developer.

With regard to a conventionally known carrier which has residual magnetization, Japanese Patent Application Laid-Open No. 59-501840 made a proposal. The carrier described in this patent is a hard type magnetic carrier which has a coercive force $H_c$ of not weaker than 300 Oe when it is magnetically saturated, thereby allowing high magnetization to remain. The carrier is used for the purpose of achieving image stability, or of stabilizing density of images and preventing adhesion of the carrier, in a high-speed copying process with a rotating magnet core-type magnetic applicator, and it can be said that the carrier having the residual magnetization as described in the proposal mentioned above is used exclusively for a developing method for which the developing process with the rotating magnet core-type applicator or the like is indispensable.

Examinations made by the inventors indicated that slight residual magnetization is produced even in a carrier which has a coercive force $H_c$ lower than 300 Oe, and that the carrier in which the residual magnetization is produced is in rather a moniliform condition as shown in FIG. 1A even in an atmosphere free from a magnetic field and agglomerated gradually at higher degrees as development is repeated from a condition where the carrier is not magnetized (see FIGS. 1A through 1C). Furthermore, it could be observed that the phenomenon was remarkable in a resin carrier which had a small particle diameter in particular, and that paramagnetism was produced and changed with time when a carrier had a coercive force which was smaller than a maximum value of an intensity of a magnetic field on a developing magnetic pole. In contrast, it was found that the carrier could not be magnetized by the developing magnetic pole and a variation of residual magnetization did not cause the variation of fluidity with time described above when a coercive force was larger than the maximum value of the intensity of the magnetic field on the developing magnetic pole or zero. That is, the examinations made by the inventors clarified that residual magnetization is produced in a magnetic carrier having a coercive force which is not zero and smaller than the maximum value of the intensity of the magnetic field on the developing magnetic pole, thereby agglomerating the carrier at higher degrees as development is repeated and constituting a cause for degradation of carrier characteristics such as a fluidity.

Furthermore, it is considered that the content of toner in the developer at the time of reproduction of many copies is changed for the reason given below. As the fluidity of carrier is lowered, a replenished toner is poorly taken into the carrier, and as a result, a sensor which detects the toner content in the developer judges the amount of the toner to be excessive and functions to prevent the toner from being replenished to the carrier. It is considered that insufficiency of the toner which is taken into the carrier increases portions of the toner which are electrified insufficiently and reversely, thereby inversion component of charge appears as fog on the non-image areas. In the case when there occurs the lowering of the toner taken into the carrier, the increase of the portions of the toner which are electrified insufficiently and reversely was clarified by observing a transition of a distribution of electrified charge quantity.

However, there has been proposed no effective method to solve the problem that image densities are lowered when development is repeated to reproduce a large number of copies using a developer which contains a resin carrier as described above or a problem of the fog on the non-image areas which is produced when a toner is replenished repeatedly to keep the toner content in a developer at a constant level.

SUMMARY OF THE INVENTION

A primary object of the present invention is to provide a developing method which does not allow a fluidity of a developer to be changed and stabilizes a toner content in a developer even when development is repeated to obtain a large number of copies, thereby making it possible to stably obtain images free from density variations.

Another object of the present invention is to provide a developing method which maintains a uniform and stable distribution of electrified charge quantity on a toner even when development is repeated to obtain a large number of copies, thereby being capable of stably providing images free from fog.

Still another object of the present invention is to provide a developing method which is capable of stably supplying images which have a high image quality and to which a carrier adheres in a suppressed amount.

According to the present invention, there is provided a developing method comprising the steps of:

stirring a two component-type developer for electrophotography which contains at least a toner and a carrier in a developer container with a stirring screw;

conveying said developer to a developing section with a conveying screw and a developer carrying member which has a structure rotating around an outer circumference of a fixed magnet core; and developing an electrostatic latent image formed on an image holding member by forming a magnetic brush on a developing magnetic pole at said developing section, wherein said carrier is a magnetic material dispersion-type resin carrier which contains at least a binder resin and a metal oxide, and has a coercive force $H_c$ of 20 to 300 Oe, and said carrier has been previously exposed and magnetized in a magnetic field which is larger than a maximum value of an intensity of a vertical magnetic field on a surface of the developer carrying member, and said developer carrying member has a surface shape which satisfies the following conditions:

$0.2\ \mu m \leqq$ average roughness of centerline (Ra) $\leqq 5.0\ \mu m$, $10\ \mu m \leqq$ average interval between concavity and convexity (Sm) $\leqq 80\ \mu m$, $0.03 \leqq Ra/Sm \leqq 0.5$, wherein the reference symbol Ra represents an average roughness of centerline as measured in compliance with JIS-B0601 and the reference symbol Sm designates an average interval between concavity and convexity as measured in compliance with ISO 468.

BRIEF DESCRIPTION OF THE DRAWINGS

FIG. 1A showing the initial state of the carrier, FIG. 1B showing the state of the carrier after it is used for successive reproduction of 1,000 copies and FIG. 1C showing the state of the carrier after it is used for successive reproduction of 10,000 copies;

DETAILED DESCRIPTION OF THE PREFERRED EMBODIMENTS

Figure 1A:
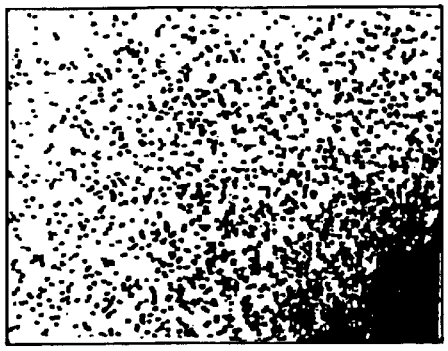
FIGS. 1A, 1B and 1C are diagrams illustrating relationship between residual magnetization and carrier conditions and showing the states of a carrier conventionally used.
Figure 1B:
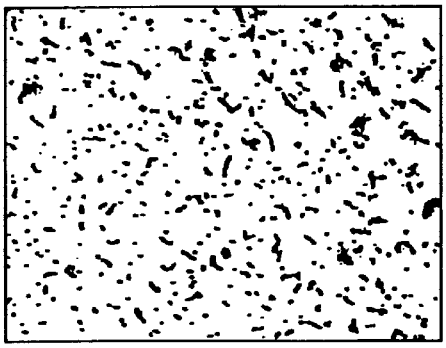

The developing method according to the present invention accomplishes the objects of the present invention described above by improving magnetic characteristics of a magnetic material dispersion-type resin carrier which has a weak coercive force and developing conditions. Elaborate examinations which were made by the inventors have clarified that when a carrier having previously been exposed to and magnetized in a magnetic field which is larger than a maximum value of an intensity of a vertical magnetic field on a surface of developer carrying member is used in the development, it is possible to prevent residual magnetization of the carrier from being varied with time during development even after repeating the coping operations, thereby suppressing a change in a fluidity of the carrier and remarkably enhancing a stability in the image formation. That is, use of such a carrier makes it possible to prevent a fluidity of a developer from being varied even by repeating the copying operation to reproduce a large number of copies, to obtain a developer having stabilized toner concentration, and to provide images with stabilized densities in the image formation. Further, a uniform and stable distribution of charge quantity in the toner can be maintained regardless of the reproduction of a large number of copies, thereby providing images free from fog.

It has also found that a carrier which has stable residual magnetization is capable of effectively preventing carrier adhesion which is liable to occur in the vicinities of a development nip. In the vicinities of the development nip the magnetic field is weak, and thereby the carrier adhesion easily occurs. And, it is considered that the carrier adopted for the developing method according to the present invention has stable residual magnetization, thereby being in a state where the carrier is agglomerated at a certain degree and suppressed from flying to a photosensitive drum.

The present invention will be described in detail below with reference to a preferable embodiment thereof.

The carrier used for the developing method according to the present invention hardly changes the residual magnetization with lapse of time even use for a long period of time and is suppressed from changing in the fluidity since the carrier has previously been exposed to the magnetic field of an intensity which is larger than the maximum value of the intensity of the vertical magnetic field on the surface of the developer carrying member.

More specifically, the carrier used for the developing method according to the present invention has a variation ratio of agglomeration degree between stages before and after exposure for one minute to a parallel magnetic field having an intensity equal to a maximum value of an intensity of a vertical magnetic field on a surface of a developer carrying member, of preferably 5% or lower based on the agglomeration degree before exposure, more preferably 3% or lower, particularly preferably 2% or lower. The agglomeration degree is an index of the fluidity of the carrier.

If the variation ratio of agglomeration degree of the carrier before and after the exposure is 5% or lower, the developer has a stabilized charge quantity from the initial stage, and the fluidity of the developer is suppressed from deteriorating even at the time of reproducing a large number of copies. As a result, good images with controlled fog can be obtained over a long time from the beginning of reproduction to continuous reproduction of a large number of copies.

An agglomeration measuring method adopted for the carrier according to the present invention will be described below:

A carrier as a sample to be measured is put into a cylindrical sample container which has a diameter of 5.9 mm, a depth of 2.9 mm and a volume of V ($cm^3$), one level containerful of the carrier is taken while taking care not to apply a share and the weight M (g) of the carrier is measured. Using the volume V and the weight M, a bulk density (M/V) is calculated. Separately, its true density is measured. An agglomeration degree X is determined by the following equation:

Agglomeration degree $X$=True density/Bulk density

The variation ratio of the agglomeration degree before and after the exposure was determined using average values which were obtained by repeating measurements of agglomeration degrees ten times each before the exposure and after the exposure.

The intensity of the magnetic field which is used for preliminarily magnetizing the carrier must be higher than the maximum value of the intensity of the vertical magnetic field on the surface of the developer carrying member and it is preferable that the intensity is 1.5 to 10 times as high. An intensity which is lower than the maximum value of the intensity of the vertical magnetic field on the surface of the developer carrying member is not preferable since it allows the carrier to be magnetized as it is used in reproduction of copies for a long time in a developing apparatus, thereby allowing an agglomeration degree of the carrier to be varied remarkably as time elapses. By preliminarily magnetizing the carrier in a magnetic field which has an intensity 1.5 time or more as high as the maximum value, it is possible to almost completely prevent the agglomeration degree of the carrier from being varied with time, thereby obtaining stable and favorable results. An intensity which is more than 10 times as high as the maximum value tends to provide too high residual magnetization, thereby making it difficult to loosen agglomeration of the developer and this tendency is more remarkable when the carrier has a coercive force exceeding 100 Oe in particular.

For the developing method according to the present invention which preliminarily exposes the carrier to a magnetic field having the intensity higher than the maximum value of the intensity of the vertical magnetic field on the surface of the developer carrying member, it is preferable to select a value of 0.5 to 2.0 kOe as the maximum value of the intensity of the vertical magnetic field on the surface of the developer carrying member. A maximum value of the intensity of the vertical field on the surface of the developer carrying member which is lower than 0.5 kOe is not preferable since such a value makes it difficult to maintain a developer on the developer carrying member and may allow the developer to splash or scatter while the developer carrying member is rotating. A maximum value of the intensity of the vertical magnetic field on the surface of the developer carrying member which is higher than 2.0 kOe strengthens a magnetic force to restrict the developer, but may increase a share for the toner contained in the developing apparatus, thereby deteriorating the toner.

Intensities of magnetic fields used in the present invention were measured using Handy Gauss Meter Model 4048 (manufactured by FW-BELL) in combination with transverse type probes which are arranged along lines of magnetic force. Furthermore, the developing method according to the present invention uses the magnetic material dispersion-type resin carrier which preferably has a coercive force not weaker than 20 Oe and not stronger than 300 Oe, more preferably not higher than 100 Oe. Since it is sufficient for the developing method according to the present invention to preliminarily magnetize the carrier by exposing it to a magnetic field having an intensity of a maximum intensity of a magnetic field to which the carrier may be exposed in the developing apparatus as described above, the carrier may have a high coercive force, but a coercive force not lower than 300 Oe allows residual magnetization higher than required to remain after exposing the carrier to a magnetic field, thereby making it necessary to remarkably improve a developer stirring system in the developing apparatus.

A coercive force $H_c$ of the carrier adopted for the developing method according to the present invention was measured using Oscillating Magnetic Field type Automatic Magnetic Characteristic Recorder BHV-30 manufactured by Riken Electronics (Ltd.). Speaking more concretely, the coercive force $H_c$ was determined by exposing the carrier charged in a cylindrical sample case to a magnetic field having an intensity of ±1 kOe and reading an external magnetic field at a point where a magnetic force is 0 emu (an intercept of an abscissa) from a hysteresis curve traced by the exposure.

The developing method according to the present invention preliminarily exposes the carrier to the magnetic field having the intensity higher than the maximum intensity of the magnetic field on the surface of the developer carrying member to suppress the variation of the developer with time. Though the carrier which has been exposed is agglomerated at a degree higher than that before the exposure, the developing method according to the present invention uses the carrier preferably by selecting a specific surface shape for the developer carrying member, a specific stirring method for the developer and specific conditions for development.

To stabilize image formation, the developing method according to the present invention uses a developer carrying member having a surface shape which preferably satisfies the following conditions:

0.2 μm≦average roughness of centerline (Ra)≦5.0 μm,

10 μm≦average interval between concavity and convexity (Sm)≦80 μm, 0.03≦Ra/Sm≦0.5, more preferably, 0.5 μm≦average roughness of centerline (Ra)≦3.0 μm, 15 μm≦average interval between concavity and convexity (Sm)≦50 μm, 0.03≦Ra/Sm≦0.5, wherein the reference symbols Ra and Sm are values which are specified by JIS-B0601 and ISO 468 to define average roughness of centerline, and an average interval between concavity and convexity, and calculated by the following equations respectively:

$$Ra = (1/l)\int_0^l |f(x)|dx$$

$$Sm = (1/n)\sum_{i=1}^{n} Sm_i$$

wherein f(x) is a curve of roughness when the measuring direction is made x axis and the roughness when a centerline is made 0 is made y axis, l is a length measured, and $Sm_i$ is an interval between concavity and convexity.

When a developer carrying member which has average roughness of centerline Ra smaller than 0.2 μm is used, the developer has an insufficient conveyance capability, thereby tending to allow uneven images and uneven image densities to be formed when the developer carrying member is used in continuous reproduction of copies for a long time. When Ra exceeds 5.0 μm, in contrast, the developer carrying member exhibits an excellent conveyance capability, but restricting members such as a blade which restrict an amount of the developer conveyed exert too strong restricting forces, whereby a toner is apt to be deteriorated by friction and image qualities are degraded when many copies are reproduced.

When a developer carrying member which has the average interval between concavity and convexity Sm larger than 80 μm is used, a developer can hardly be held on the developer carrying member, thereby lowering image densities. Though detail of a cause for the lowering in the image densities is unknown, it is considered that the developer functions as densely packed lumps and exert a force exceeding a holding force between the developer carrying member and the developer since the restricting members such as the blade which restrict the conveyed amount of the developer slide on the developer carrying member when the interval between concavity and convexity on the irregular surface of the developer carrying member is too large. It is considered that when the average interval between concavity and convexity, Sm is smaller than 10 μm, in contrast, most of concavities and convexities on the surface of the developer carrying member are smaller than an average particle diameter of the developer, whereby only particles of the developer which have small sizes may penetrate into the concavities and fine particle components of the developer are apt to cause melt-adhesion. In this case, it is difficult to manufacture an adequate developer carrying member.

From the viewpoints described above, it is important to determine an adequate inclination of concavities and convexities (∞f(Ra/Sm) from a height of the convexities and an interval between the concavities and convexities on the developer carrying member. According to the examinations made by the inventors, an inclination of the concavities and convexities within a range from 0.03 to 0.5 provides a favorable result and an inclination within a range from 0.07 to 0.3 provides a result which is excellent in particular. When Ra/Sm is smaller than 0.03, the developer carrying member has a weak force to hold the developer thereon and can hardly hold the developer thereon, whereby the conveyed amount of the developer is not controlled by the restricting members and uneven images are formed as a result. When Ra/Sm exceeds 0.5, in contrast, the developer which has penetrated into the concavities in the surface of the developer carrying member can hardly circulate with the rest portion of the developer, thereby causing melt-adhesion of the developer.

In the present invention, Ra and Sm were measured with Contact Type Surface Roughness Meter SE-3300 (manufactured by Kosaka Research Institute, Co., Ltd.) in compliance with JIS-B0601 and ISO 468, respectively.

To manufacture the developer carrying member having the predetermined surface roughness described above which is to be used for carrying out the developing method according to the present invention, it is possible to select, for example, a sandblast method which uses particles having indefinite and definite shapes as abrasive grains, a sandpaper method which rubs a sleeve surface with a sandpaper in an axial direction to form concavities and convexities in a circumferential direction of a sleeve, a method which utilizes a chemical treatment or a method which forms resin concavities in a surface coated with an elastic resin.

Figure 3:
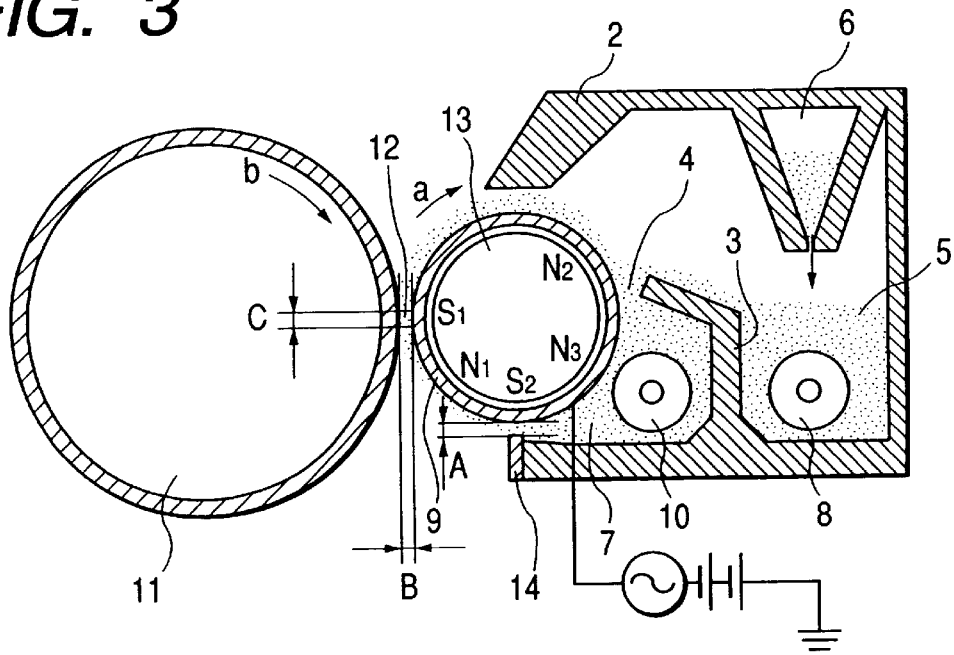
FIG. 3 is a schematic sectional view exemplifying a developing apparatus which carries out the developing method according to the present invention.

Furthermore, it is desirable that the developer carrying member used for carrying out the developing method according to the present invention is rotated in such a direction as to draw up the developer while moving it against gravity in a developing area (see FIG. 3). An apparatus which carries out the developing method according to the present invention is configured to collect the developer once into a developer reservoir inside the developer restricting member as shown in FIG. 3 and since the developer reservoir is disposed in the vicinity of a stirring screw, a configuration which is configured to draw the development agent upward collects the developer in a smaller amount into the development agent reservoir than a configuration which is configured to send out the developer downward. It is considered that an apparatus which has the former configuration can accelerate stirring of the developer and stabilize conveyance of the developer to the developer carrying member, thereby making it possible to obtain a uniformly coated condition of the developer and more stably forming favorable images.

Furthermore, it is preferable for the developing method according to the present invention to adopt a counter type developing apparatus in which the developer carrying member and an image holding member are rotated in directions reverse to each other. The counter type developing apparatus which permits moving a magnetic brush at a higher speed relative to the image holding member makes it possible to upgrade image gradations and can be configured compact.

In the developing method according to the present invention which is configured to carry and convey the developer to the developing section by the developer carrying member which has the surface shape described above and develop an electrostatic latent image on the image holding member in the developing section, the developer is carried onto the developer carrying member as described below. The two component-type developer containing a toner and a carrier which is used for the developing method according to the present invention is conveyed onto the surface of the developer carrying member by means of a conveying screw after the toner and the carrier have been stirred by a stirring screw in a developer storage chamber, and then transported to the developing section by the developer carrying member which has the structure rotating around the outer circumference of a fixed magnetic core, whereafter an electrostatic latent image is developed by forming a magnetic brush on a developing magnetic pole in the developing section. The developing method according to the present invention is preferably configured to rotate the conveying screw at a circumferential speed ratio of 0.3 to 1.5 relative to the developer carrying member. A circumferential speed ratio exceeding 1.5 is too high enough to result in deterioration of the developer, whereas a circumferential speed lower than 0.3 makes it impossible to obtain a sufficient stirring condition, thereby making it difficult to loosen the agglomeration of the carrier and mix it well with the toner.

Figure 4:
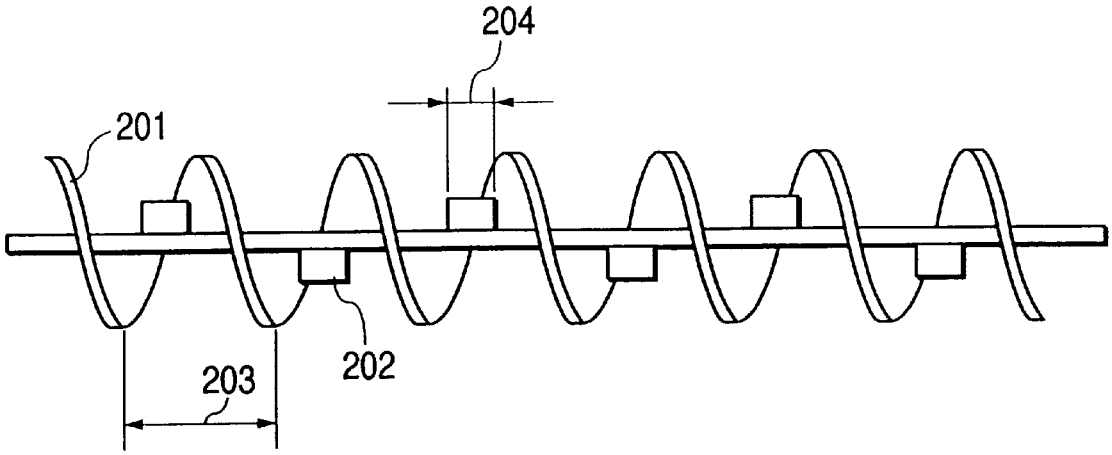
FIG. 4 is a schematic diagram exemplifying stirring screw preferably used for the developing method according to the present invention.

Furthermore, the developing method according to the present invention adopts a conveying screw and a stirring screw which have stirring blades arranged at a pitch of 10 to 30 mm. When the stirring blades are arranged as a pitch narrower than 10 mm, the developer is conveyed at a slow speed in an axial direction, thereby lowering response during replenishment of the toner. When the stirring blades are arranged at a pitch exceeding 30 mm, on the other hand, the developer is conveyed at too high a speed, thereby being stirred insufficiently. Furthermore, it is preferable that the stirring screw has stirring ribs which have an axial length in particular preferably within a range from 20 to 90% of the pitch of the blades. An axial length of the stirring ribs exceeding 90% of the pitch of the blades is not preferable since it slows down a speed to convey the developer. When the length of the stirring ribs is within the range from 20 to 90% of the pitch of the blades, the stirring and conveyance of the developer are performed with good balance. A stirring screw which has the stirring ribs is schematically shown in FIG. 4.

It is preferable that the carrier which is used for the developing method according to the present invention has a number average particle diameter of 5 to 50 μm. A carrier which has a particle diameter smaller than 5 μm is not preferable since the carrier is excessively agglomerated magnetically, thereby tending to hardly allow a toner to be taken into the carrier. In contrast, a carrier having a particle diameter larger than 50 μm has an agglomerating force produced by residual magnetization which is weaker than gravity, thereby making the preliminary magnetization of carrier described above insignificant.

Furthermore, it is preferable that the carrier to be used for the developing method according to the present invention has a shape factor SF-i within a range from 100 to 140 and a shape factor SF-2 within a range from 100 to 120. It is more preferable that the carrier has the shape factor SF-i from 100 to 120 and the shape factor SF-2 from 100 to 110. By controlling the shape of the carrier within the range specified above and carrying out development by means of a developing apparatus which is provided with a developer carrying member having the specific surface shape, a stirring screw and a conveying screw, it is possible to minimize agglomeration of a carrier, favorably mix it with a toner and enhance the fluidity of a developer even when the carrier has high agglomerating property like that adopted for the developing method according to the present invention, thereby obtaining images which have suppressed fog and stable image densities even after continuous reproduction of a large number of copies for a long time. Furthermore, a carrier which has the shape factors mentioned above has smooth particle surfaces, thereby being capable of effectively preventing a toner from adhering to the carrier surfaces, or suppressing the so-called toner spent, and further stabilizing image formation even when the developer is used for a long time.

Description will be made of methods which were adopted by the present invention to measure the number average particle diameter and the shape factors. Using Image Processing Analyzer Luzex 3 manufactured by NIRECO CORP., image analyses were conducted on 300 or more carrier particles which were sampled at random with an optical microscope. The number average particle diameter was calculated from particle diameters which were measured as horizontal Feret's diameters. The shape factors, SF-1 and SF-2 were calculated on the basis of image analysis data by the following formulae:

$$SF\text{-}1 = \frac{(MXLNG)^2}{\text{AREA}} \times \frac{\pi}{4} \times 100$$

$$SF\text{-}2 = \frac{(PERI)^2}{\text{AREA}} \times \frac{1}{4\pi} \times 100$$

(wherein the reference symbol AREA represents a projection area of a particle, the reference symbol MXLNG designates a maximum absolute length of the particle and the reference symbol PERI denotes a circumferential length of the particle.)

Furthermore, the carrier used in the present invention may be a magnetic material dispersion-type resin carrier comprising a binder resin and a metal oxide contained therein. The metal oxide may preferably be contained in an amount of 30 to 99 wt. % in the carrier. When the metal oxide is contained in an amount lower than 30 wt. %, the carrier can hardly have a sufficient magnetic force, thereby being liable to adhere to the photosensitive member during development. When the metal oxide is contained in an amount exceeding 99%, on the other hand, the carrier can hardly have sufficient strength.

Various kinds of metal oxides can be used as the metal oxides for dispersion in a binder resin for forming the carrier. One kind of metal oxide may be dispersed in a binder resin to form a carrier, but it is more preferable to use a mixture of two or more kinds of metal oxides. For example, combinations of magnetite and hematite, magnetite and $\gamma$-$Fe_2O_3$, magnetite and $SiO_2$, magnetite and $Al_2O_3$, magnetite and $TiO_2$, and magnetite and Cu—Zn type ferrite are preferred, and in some cases, a small amount of hard ferrite such as barium ferrite may be mixed. Among them, a combination of magnetite and hematite is preferable from the viewpoints of the manufacturing cost and strength.

Furthermore, in the developing method according to the present invention, it is preferable to use a resin-coated carrier which is prepared by coating a core material surface with a resin, as the magnetic material dispersion-type resin carrier. In this case, a preferable core material for the carrier has a number average particle diameter of 5 to 50 μm, and contains a metal oxide in a binder resin.

Though the binder resin used to prepare the carrier or carrier core material in the present invention depends upon the preparation method thereof, thermoplastic resins mentioned below may preferably be used when the carrier or carrier core material is to be prepared by a pulverization method in which a magnetic material is mixed with a resin and melt-dispersed therein by applying heat followed by pulverization into particles with an appropriate diameter. Specifically, the thermoplastic resins which are preferably used to prepare the carrier or carrier core are polystyrene, polymethyl methacrylate, styrene-acrylic acid copolymer, styrene-butadiene copolymer, ethylene-vinyl acetate copolymer, polyvinyl chloride, polyvinyl acetate, polyvinylidene fluoride resin, fluorocarbon resin, perfluorocarbon resin, solvent soluble perfluorocarbon resin polyvinyl alcohol, polyvinyl acetal, polyvinyl pyrrolidone, petroleum resin, cellulose, cellulose acetate, cellulose nitrate, methyl cellulose, hydroxymethyl cellulose, hydroxyethyl cellulose, hydroxypropyl cellulose, novolak resin, low-molecular-weight polyethylene, saturated alkyl polyester resin, polyethylene terephthalate, polybutyrene terephthalate, polyarylate, polyamide resin, polyacetal resin, polycarbonate resin, polyether sulfone resin, polysulfone resin, polyphenylene sulfide resin and polyether ketone resin.

The pulverization method described above is not limitative, but it is more preferable to prepare a carrier or carrier core directly by a polymerizing method in which a metal oxide mentioned above is mixed with a polymerizable monomer which is a material to form a binder resin and additives which are additionally adopted as occasion demands. The preparation of a carrier by the polymerizing method is preferred since a carrier with the shape factors SF-1 and SF-2 within the ranges specified above can easily be obtained.

Polymerizable monomers which can be used to prepare a carrier by the polymerizing method are styrene and derivatives thereof such as styrene, o-methylstyrene, m-methylstyrene, p-methylstyrene, p-methoxystyrene, p-phenylstyrene and p-chlorostyrene; ethylenically unsaturated monoolefins with ethylene such as ethylene, propylene, butylene and isobutylene; α-methylene aliphatic monocarboxylic acid esters such as methyl methacrylate, ethyl methacrylate, propyl methacrylate, n-butyl methacrylate and isobutyl methacrylate; and acrylic esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate. These monomers can be used singly or in a combination.

In addition to the thermoplastic resins which are obtained by polymerizing polymerizable monomers mentioned above, thermosetting resins can be used as the binder resin for preparing a carrier or carrier core. The thermosetting resins as the binder resin includes, for example, phenol resin, modified phenol resin, maleic resin, alkyd resin, epoxy resin, acrylic resin, polyester resin, urea resin, melamine resin, urea-melamine resin, xylene resin, toluene resin, guanamine resin, melamine-guanamine resin, acetoguanamine resin, glyptal resin, furan resin, silicone resin, polyimide resin, polyamide-imide resin, polyether-imide resin and polyurethane resin. Polmerizable monomers which can produce the resins mentioned above may be used arbitrarily when the carrier is prepared by the polymerization method.

As to the carrier or carrier core material used in the developing method of the present invention, that prepared using phenol resin among the above resins as the binder resin is excellent in the carrier strength and preparation stability.

Specifically, as for the method for preparing a carrier or a carrier core material using thermosetting phenol resin, phenols and aldehydes which are starting monomers for phenol resins are subjected to suspension polymerization in an aqueous medium in the presence of a basic catalyst together with materials such as a magnetic iron compound as mentioned above, a non-magnetic metal oxide and a dispersion stabilizer, thereby yielding composite particles. Preferably, usable as the phenols are phenol, m-cresol, p-tert-butyl phenol, o-propyl phenol, resorcinol and bisphenol A, of which phenol may preferably be used from the viewpoints of the granulation property and the manufacturing cost. Furthermore, formaldehyde is used most preferably as the aldehydes.

When a resin-coated carrier is to be used as a carrier for the developing method according to the present invention, it is preferable to form a covering layer of a coating resin on the surface of a carrier core material which is prepared as described above. The coating resin may be a thermoplastic resin or a thermosetting resin. Examples of the thermoplastic resins include acrylic resins such as polystyrene, polymethyl methacrylate and styrene-acrylic acid copolymer; styrene-butadiene copolymer, ethylene-vinyl acetate copolymer, vinyl chloride, vinyl acetate, polyvinylidene fluoride resin, fluorocarbon resin, perfluorocarbon resin, solvent-soluble perfluorocarbon resin, polyvinyl alcohol, polyvinyl acetal, polyvinyl pyrrolidone, petroleum resin, cellulose, cellulose acetate, cellulose nitrate, methyl cellulose, hydroxymethyl cellulose, hydroxyethyl cellulose, hydroxypropyl cellulose, novolak resin, low-molecular weight polyethylene, saturated alkyl polyester resin, polyethylene terephthalate, polybutylene terephthalate, polyarylate, polyamide resin, polyacetal resin, polycarbonate resin, polyether sulfone resin, polysulfone resin, polyphenylene sulfide resin and polyether ketone resin.

Furthermore, concrete examples of the thermosetting resins include phenol resin, modified phenol resin, maleic resin, alkyd resin, epoxy resin, acrylic resin, unsaturated polyester obtainable by polycondensation of maleic anhydride and polyhydric alcohol, unsaturated polyester obtainable by polycondensation of terephthalic acid and polyhydric alcohol, urea resin, melamine resin, urea-melamine resin, xylene resin, toluene resin, guanamine resin, melamine-guanamine resin, acetoguanamine resin, glyptal resin, furan resin, silicone resin, polyimide resin, polyamide-imide resin, polyether imide resin and polyurethane resin.

The resins mentioned above may be used singly or in a combination. Furthermore, the thermoplastic resins may be mixed with hardening agents and hardened for use. The resin for forming the covering layer on the carrier surfaces may preferably be in a quantity of about 0.5 to 15 wt. %.

Figure 2:
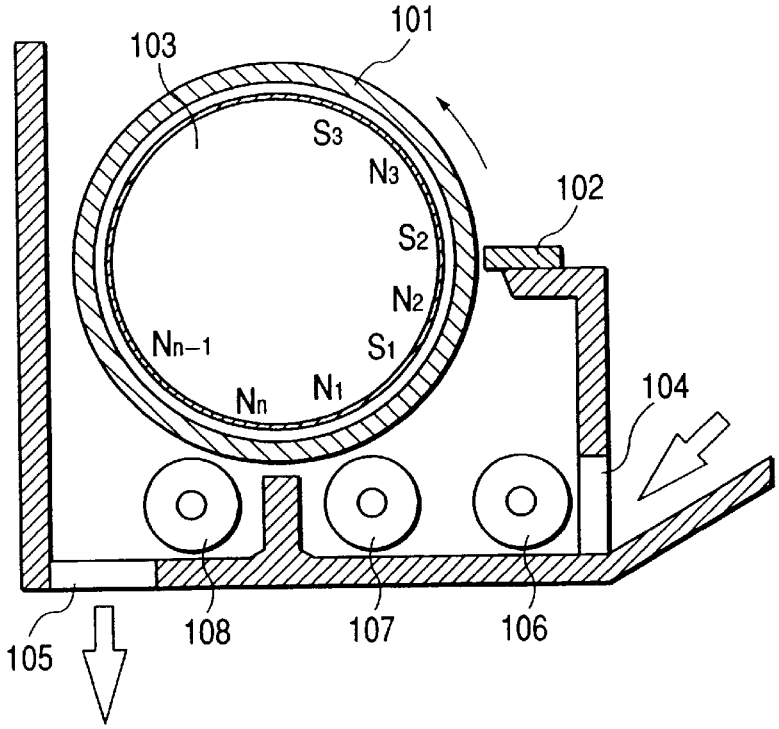
FIG. 2 is a schematic sectional view exemplifying an apparatus to magnetize a carrier.

For the developing method according to the present invention, the carrier is preliminarily exposed to a magnetic field to obtain a carrier which has stable residual magnetization, and the exposure may be carried out by various methods. A simple method is to put carrier particles into a container and expose the particles to a uniform magnetic field which is produced between two parallel planar plates composed of S and N poles of a magnet. A method to expose a large number of carrier particles at a time is to dispose a rotating sleeve 101 on an outer circumference of a fixed magnet roll 103 which has a predetermined magnetic field and magnetic poles $N_1$, $N_2$, . . . $N_n$ and $S_1$, $S_2$, . . . $S_{n-1}$ as shown in FIG. 2, and to slowly rotate the rotating sleeve 101 so that the carrier particles are fed to the rotating sleeve 101 at a constant rate by way of a restricting member 102 and exposed to the predetermined magnetic field. The carrier particles are supplied through a carrier inlet port 104, transported to the rotating sleeve 101 by conveying screws 106 and 107, and carried to the rotating sleeve 101. The carrier particles are magnetized and rotated while being supported on the rotating sleeve 101, until they are peeled from the rotating sleeve 101 upon reaching a repulsive pole located between the $N_{n-1}$ pole and the $N_n$ pole. The carrier particles which have been peeled from the rotating sleeve 101 are transported by a conveying screw 108 and recovered through a carrier recovery port 105.

Description will be made of a toner which used for the developing method according to the present invention.

Though any one of conventionally known toners can be used for the developing method according to the present invention, it is preferable to use a spherical toner which has a shape factor SF-1 of 100 to 140 and a shape factor SF-2 of 100 to 120. The toner with such a shape has an excellent fluidity and enables forming good images even when the toner is combined with the carrier according to the present invention which has a high agglomerating property.

For the purpose of obtaining the toner with the above shape, the present invention may preferably use a toner which is formed partially or entirely by the polymerizing method. According to the present invention, it is preferable to partially or entirely polymerize a toner so that it has such a form as that described above. In particular, preferred is a toner which is formed by dispersing a polymerizable monomer composition in an aqueous dispersing medium followed by the suspension polymerization because the toner is spherical and has a smooth surface.

Furthermore, the toner may preferably have a number average particle diameter of from 2.0 to 10.0 $\mu$m.

The shape factors SF-1, SF-2 and the number average particle diameter of the toner are measured by the same methods as those for the carrier.

External additives may be added if desired, to the toner used for the developing method according to the present invention. Usable external additives are metal oxides such as silica, aluminium oxide, titanium oxide, strontium titanate, cerium oxide, magnesium oxide, chrome oxide, tin oxide and zinc oxide; nitrides such as silicon nitride; carbides such as silicon carbide; metal salts such as calcium sulfate, barium sulfate and calcium carbonate; metal salts of fatty acid such as zinc stearate and calcium stearate; and carbon black.

These external additives may preferably used in an amount of 0.01 to 10 parts by weight, more preferably 0.05 to 5 parts by weight, based on 100 parts by weight of toner particles. These external additives may be used singly or in combinations of several kinds and may preferably be treated before use so as to make them hydrophobic.

Now, the developing method according to the present invention will be described with reference to FIG. 3.

FIG. 3 exemplifies a developing apparatus for carrying out the developing method according to the present invention. The developing apparatus has a developer container 2, the inside of which is partitioned by a partition wall 3 into a developing chamber 4 and a stirring chamber 5. A toner storage chamber 6 is located over the stirring chamber 5 so that a toner can adequately be fed into the developer container 2. A developer 7 which is prepared by mixing toner particles and magnetic carrier particles is accommodated in the developing chamber 4 and the stirring chamber 5, and a conveying screw 10 is disposed in the developing chamber 4. In the developing chamber 4, the developer 7 is transported in a longitudinal direction of a developing sleeve 9 by rotating the conveying screw 10. A stirring screw 8 is disposed in the stirring chamber 5 of the developer container 2 so that the developer is conveyed in the longitudinal direction of the developing sleeve 9 by rotating the stirring screw 8. The stirring screw 8 is configured to have a developer conveying direction reverse to that of the conveying screw 10 which is disposed in the developing chamber 4 to stir the toner particles and the carrier particles. Openings are formed in the partition wall 3 of the developer container 2 at locations on a front side and a deep side so that the developer which is conveyed by the stirring screw 8 is passed to the carrying screw 10 through one of the openings and the developer which is carried by the conveying screw 10 is passed to the stirring screw 8 though the other opening.

When the developer is passed as described above, the toner particles are electrified to a polarity for development of a latent image due to the friction with the magnetic carrier particles. An opening is formed in the developer container 2 at a location close to a photosensitive drum 11 and a developing sleeve 9 which is made of a non-magnetic material such as aluminum or non-magnetic stainless steel is disposed in this opening as shown in FIG. 3. The developing sleeve 9 rotates in the direction indicated by the arrow a in FIG. 3, thereby carrying and conveying the developer which is a mixture of a toner and a carrier to a developing section 12. A magnet 13 is fixed inside the developing sleeve 9. In this example, the magnet 13 has a developing magnetic pole $S_1$, and magnetic poles $N_1$, $N_2$, $N_3$ and $S_2$ which are arranged as shown in FIG. 3. In the developing system which has the configuration described above, the developer which is drawn at the pole $N_3$ by rotation of the developing sleeve 9 is conveyed from the pole $S_2$ to the pole $N_1$ while being restricted by a restricting member 14 in the course to form a thin layer of the developer on the developing sleeve 9. The developer is erected in a magnetic field produced by the developing pole $S_1$ and opposed at a location of the developing section 12 to the photosensitive drum 11 which is rotating in the direction indicated by the arrow b, thereby developing an electrostatic latent image on the photosensitive drum 11. Subsequently, the developer is transported to a repulsive magnetic field between the pole $N_3$ and the pole $N_2$ as the developing sleeve 9 rotates and dropped by the repulsive magnetic field from the developing sleeve 9 into the developing chamber 4. The developer which is dropped into the developing chamber 4 is stirred and conveyed once again by the stirring screw 8 in the stirring chamber 5 and the conveying screw 10 in the developing chamber 4, and reused for development.

When the present invention uses a developing apparatus provided with two screws of a stirring screw and a conveying screw as shown in FIG. 3, the developer is mixed sufficiently with the screws before it is fed to the developing section. Consequently, even a carrier which has a high agglomerating property like the carrier for the developing method according to the present invention is mixed sufficiently with a toner, thereby making it possible to stably provide images which have a high image density and suppressed fog from the initial stage of reproduction of copies to a stage where continuous reproduction is conducted on a large number of copies for a long time.

Now, the present invention will be described more concretely with reference to illustrative examples and comparative examples thereof which are not limitative of the present invention in any way.

EXAMPLE 1

(Preparation of carrier)

Description will be made of a preparing method of a carrier used for the developing method according to the present invention. First, a core material for a coating resin was prepared by a method described below:

| | |
|---|---|
| Phenol | 10 parts by weight |
| Formaldehyde (formaldehyde approximately 40%, methanol approximately 10%, water rest percent) | 6 parts by weight |
| Magnetite (particle diameter 0.24 $\mu$m) | 35 parts by weight |
| Hematite ($\alpha$-$Fe_2O_3$: particle diameter 0.60 $\mu$m) | 49 parts by weight |

Materials listed above were put into a flask together with 28% aqueous ammonia as a basic catalyst and calcium fluoride as a polymerization stabilizer, heated to 85° C. for 40 minutes while being stirred for mixing, and kept at this temperature for 3 hours, thereby allowing a resin to be hardened by reaction. After the resin was cooled to 30° C., 0.5 liter of water wad added to it, a supernatant liquid was removed and precipitate was washed with water and dried with air. Then, the precipitate was dried at 50 to 60° C. under a reduced pressure (5 mmHg or lower), thereby forming a spherical carrier core in a condition where magnetite and hematite were bound with a phenol resin functioning as a binder.

Figure 1C:
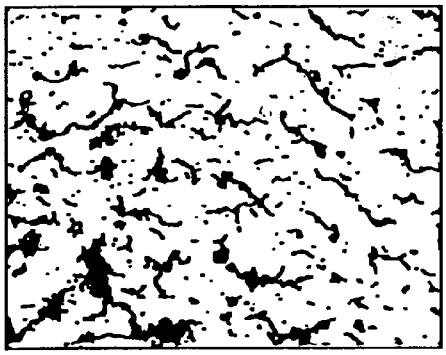

A surface of the carrier core thus obtained was coated with a thermosetting silicone resin in procedures described below. Using toluene as a solvent, 10 wt. % coating solution was prepared for the carrier core so that resin was coated at 1 wt. %. The surface of the carrier core was coated with the solution by evaporating the solvent while continuously applying a shearing stress. After curing particles at 250° C. for one hour, a carrier was ground and sifted with a sieve of 100 mesh. Carrier particles thus obtained were exposed to a parallel magnetic field of 2.0 kOe for 1 minute, thereby forming a carrier 1 to be used in Example 1. Microscopy of the particles before exposure to the magnetic field indicated a small number of moniliform linked portions as shown in FIG. 1A, whereas microscopy of the particles after the exposure allowed moniliform linked portions to be clearly recognized as shown in FIG. 1C. The carrier 1 prepared as described above had a number average particle diameter of 33 μm, shape factors SF-1 and SF-2 of 115 and 110, respectively, a coercive force $H_c$ of 75 Oe and a agglomeration degree of 2.02.

(Preparation of toner)

In Example 1, a cyan toner was prepared in procedures described below:

| | |
|---|---|
| Polyester resin obtained by condensing propoxylated bisphenol and fumaric acid | 100 parts by weight |
| Copper phthalocyanine pigment | 5 parts by weight |
| Chromium complex salt of di-tert-butyl salicylate | 4 parts by weight |

Materials mentioned above were preliminarily mixed sufficiently, melted, kneaded, cooled and coarsely hammer milled into particles having particles sizes of approximately 1 to 2 mm. Then, the particles were pulverized with an air jet type atomizer. Furthermore, fine particles thus obtained were classified with an elbow jet classifier, thereby obtaining negatively chargeable, cyanic finely pulverized powder of resin composition.

Using a Henschel mixer, 100 parts by weight of the finely pulverized powder was mixed with 1.2 parts by weight of titanium oxide treated in hydrophobic condition, thereby preparing a toner 1. The toner 1 thus prepared had a weight average particle diameter (D4) of 6.4 μm, a number average particle diameter of 4.8 μm, and shape factors SF-1 and SF-2 of 130 and 121, respectively.

The carrier 1 prepared as described above had a coercive force $H_c$ of 75 Oe and was exposed to a parallel magnetic field of 1 kOe for one minute. Measurements of agglomeration degrees of the carrier conducted before and after the exposure indicated 2.02 and 2.04, respectively, or a variation ratio of 0.9%.

The carrier 1 and the cyan toner which were obtained above were mixed so that the toner was in an amount of 8.0 wt. %, thereby obtaining a two component-type developer. This developer was put into a developing apparatus such as that shown in FIG. 3 under an environment of an ordinary temperature and humidity (25° C./60% RH) and copies were reproduced with modified Canon Full Color Laser Copying machine CLC-500. In the apparatus shown in FIG. 3, a distance A between the developing sleeve 9 and the developer restricting member 14 was set at 600 μm, and a distance B between the developing sleeve 9 and the electrostatic latent image bearing member was set at 500 μm. The developing nip was 5.1 mm in this case. A peripheral speed ratio between the developing sleeve 9 and the conveying screw 10 was set at 2:1, and a maximum value of a vertical magnetic field intensity of the developing sleeve 1 was set at 1 kOe (developing pole $S_1$). The developing sleeve had average roughness of centerline (Ra) of 1.10 μm, an average interval (Sm) between concavity and convexity of 27 μm, and a ratio Ra/Sm of 0.04. In FIG. 4, a pitch 203 of blades of the stirring blades 201 of the stirring screw 8, a length 204 of the stirring ribs 202 and a pitch of the stirring blades of the conveying screw were set at 20 mm, 8 mm and 20 mm, respectively. Furthermore, an alternating electric field of 2 kV (voltage between peaks) and a rectangular wave having a frequency of 2 kHz were selected as developing conditions so that a developing bias voltage was −470 V. Furthermore, a toner developing contrast ($V_{cont}$) and fog removing voltage ($V_{back}$) were set at 340 V and 100 V, respectively. Furthermore, a primary charging voltage for the photosensitive drum was set at −570 V. In these conditions, 30,000 copies were reproduced by developing a digital latent image on the photosensitive drum 1 for durability test of the developer.

The developer was sampled and toner concentrations in the developer were measured with image reproduction intercepted at an initial stage of the durability test, each upon completing reproduction of 1,000 copies, 3,000 copies, 10,000 copies and 30,000 copies. The measurements provided results which indicated that toner concentrations in the developer were stable nearly at a level set at the initial stage. Microscopy of the developer sampled upon completing reproduction of 30,000 copies indicated no adhesion of the toner to a surface of the carrier, thereby allowing recognition that the developer is free from the toner spent.

The toner concentration in the developer was measured as described below:

After approximately 3 g of the developer was put into a centrifuge tube (approximately 100 ml) for centrifugal separation and weighed precisely, 50 ml of water containing a small amount of surface-active agent was added and the developer was stirred for 10 minutes with a ultrasonic cleaner. Then, the developer was separated at 3500 rpm for approximately 5 minutes with a centrifugal separator and supernatant liquid was removed with a dropping pipette. After the supernatant liquid was removed, 50 ml of water containing the surface active agent was added once again to the developer and cleaning was repeated similarly three times. After completing the third cleaning, rest carrier was dried under a reduced pressure, then left standing for two days at normal temperature and normal pressure, and precisely weighed. A toner concentration was calculated using a difference between an initial weight and a final weight of the developer as a weight of the toner.

Furthermore, the reproduced images were scarcely varied with time from the initial stage, free from fog and high in densities of solid image areas, and had high reproducibilities of half tones and linear images.

Using a value which was obtained by subtracting reflectance of a recording paper from reflectance of white areas of output images measured with Reflectometer TC-6DS (manufactured by Tokyo Denshoku), fog was evaluated according to criteria listed below:

A: Lower than 1.5%

B: 1.5% or more and lower than 2.5%

C: 2.5% or more and lower than 4.0%

D: 4.0% or more

Upon completing reproduction of a 3000th copy, a solid black image was output and image unevenness on the image was visually checked for evaluation on the basis of criteria listed below:

A: Image unevenness not produced

B: Slight image unevenness observed

C: Image unevenness remarkable

Evaluation results of for going are summarized in Table 2.

EXAMPLE 2

A carrier 2 was manufactured in the same procedures as those in Example 1, except for exposure (magnetization) of the carrier to a parallel magnetic field of 3 kOe. Images were reproduced in the same conditions as those in Example 1, except for the carrier 2 which was used in place of the carrier 1. Obtained images were in favorable conditions where the images were free from fog, and stable in densities of solid image areas, reproducibility of half tone and reproducibility of linear images. Physical properties of the carrier 2 are listed in Table 1 and image evaluation results are summarized in Table 2.

COMPARATIVE EXAMPLE 1

A carrier 3 was manufactured in the same procedures as those in Example 1, except for the exposure to a parallel magnetic field which was omitted. Images were reproduced in the same conditions as those in Example 1, except for the carrier 3 which was used in place of the carrier 1. The toner was taken well into the carrier and images exhibited high reproducibility at an initial stage of the image reproduction, but fog was gradually produced at a white ground part after approximately 3,000 copies were reproduced. Physical properties of the carrier 3 are listed in Table 1 and image evaluation results are summarized in Table 2.

COMPARATIVE EXAMPLE 2

A carrier 4 was manufactured in the same procedures as those in Example 1, except that the carrier was magnetized in a parallel magnetic field of 200 Oe. Images were reproduced in the same conditions as those in Example 1, except for the carrier 4 which was used in place of the carrier 1. The toner was taken well into the carrier and images exhibited high reproducibility at an initial stage of the image reproduction, but fog was gradually produced at a white ground area after approximately 3,000 copies were reproduced. Physical properties of the carrier 4 are listed in Table 1 and image evaluation results are summarized in Table 2.

EXAMPLE 3

A carrier 5 was manufactured in the same conditions as those in Example 1, except for hematite which was used in a smaller amount to be contained in the carrier and barium ferrite which was used in place of an eliminated amount of hematite. Copies were reproduced in the same procedures as those in Example 1, except for the carrier 5 which was used in place of the carrier 1. The copies were stable in reproducibilities of solid images, half tone images and linear images, but slightly affected by fog and toner concentrations in the developer were more or less varied. Physical properties of the carrier 5 are listed in Table 1 and image evaluation results are summarized in Table 2.

COMPARATIVE EXAMPLE 3

A carrier 6 was manufactured in the same conditions as those in Example 1, except for barium ferrite which were selected as metallic oxides to be contained in the carrier. Copies were reproduced in the same procedures as those in the Example 1, except for the carrier 6 which was used in place of the carrier 1. The toner was taken into the carrier at a slightly lower ratio, whereby fog was slightly produced after approximately 100 copies were reproduced and remarkable on an entire surface of a 1000th image. Physical properties of the carrier 6 are listed in Table 1 and image evaluation results are summarized in Table 2.

EXAMPLE 4

| | |
|---|---|
| Phenol | 12 parts by weight |
| Formaldehyde (approximately 40% of formaldehyde, approximately 10% of methanol and rest percent of water) | 7 parts by weight |
| Magnetite (particle diameter 0.24 $\mu$m) | 38 parts by weight |
| Hematite ($\alpha$-$Fe_2O_3$: particle diameter 0.60 $\mu$m) | 46 parts by weight |

Materials mentioned above were put into a flask together with 28% ammonia water and calcium fluoride which were selected as a basic catalyst and a polymerization stabilizer respectively, heated to 85° C. in 40 minutes while being stirred and mixed, and kept at this temperature for three hours to harden a resin. Then, the resin was cooled to 30° C., 0.5 liter of water was added to the resin, a supernatant liquid was removed, and precipitate was washed with water and dried with air. The resin was dried at 50 to 60° C. under a reduced pressure (5 mmHg or lower) while applying a share to particles by stirring the resin, thereby forming a spherical carrier core in a condition where the phenol resin bound the magnetite with hematite.

A carrier 7 was prepared in the same conditions as those in Example 1, except for the carrier core 7 in which is obtained above. Copies were reproduced in the same conditions as those in Example 1, except for the carrier 7 which was used in place of the carrier 1. The reproduced copies were stable in reproducibilities of solid images, half tone images and linear images, but image densities were more or less lowered and slight fog was produced as the carrier was used for a longer time. Physical properties of the carrier 7 are listed in Table 1 and evaluation results are summarized in Table 2.

EXAMPLE 5

Images were reproduced in the same conditions as those in Example 1, except for a developing sleeve B which had a maximum value of a vertical magnetic field intensity of 1 kOe (developing pole $S_1$), average roughness of centerline (Ra) of 3.5 $\mu$m, an average interval between concavity and convexity (Sm) of 35 $\mu$m and Ra/Sm of 0.1. Reproduced images were in favorable conditions where they were free from fog, and stable in reproducibilities of solid images, half tone images and linear images, but image densities were slightly lowered as the carrier was used for a longer time. Evaluation results are summarized in Table 2.

EXAMPLE 6

Images were reproduced in the same conditions as those in Example 1, except for a developing sleeve C which had a maximum value of a vertical magnetic field intensity of 700 Oe (developing pole $S_1$), average roughness of centerline (Ra) of 0.2 $\mu$m, an average interval between concavity and convexity (Sm) of 15 $\mu$m and Ra/Sm of 0.013. Reproduced images were in favorable conditions where they were free from fog, and stable in reproducibilities of half tone images and linear images, but more or less image unevenness was observed on the solid images. Evaluation results are summarized in Table 2.

COMPARATIVE EXAMPLE 4

Images were reproduced in the same conditions as those in Example 1, except for a developing sleeve D which had a maximum value of a vertical magnetic field of 1 kOe (developing pole Sl), average roughness of centerline (Ra) of 6.0 $\mu$m, an average interval between concavity and convexity (Sm) of 40 $\mu$m and Ra/Sm of 0.15. The developer was in a slightly large amount in the vicinity of a developing nip part, thereby producing more or less fog from an initial stage of the image reproduction. In addition, reproducibility of thin lines was gradually lowered after approximately 3000 copies were reproduced. Evaluation results are summarized in Table 2.

COMPARATIVE EXAMPLE 5

Images were reproduced in the same conditions as those in Example 1, except for a developing sleeve E which had a maximum value of a vertical magnetic field intensity of 1 kOe (developing pole $S_1$), average roughness of centerline (Ra) of 0.1 μm, an average interval between concavity and convexity (Sm) of 3.5 μm and Ra/Sm of 0.029. The sleeve had a weak developer-conveying power, whereby an amount of the developer was unstable in the vicinity of the developing nip part while a developing bias voltage was applied, thereby producing ununiformities in image densities. Evaluation results are summarized in Table 2.

EXAMPLE 7

A developer was prepared in the same conditions as those in Example 1, except for a toner 2 which was obtained in procedures described below and images were reproduced using the developer thus obtained. Reproduced images were highly precise, minute, free from fog and stable, thereby having high qualities even after the developer was used for a large number of copies. Evaluation results are summarized in Table 2.

(Preparation of toner)

450 parts by weight of an aqueous solution of 0.1 M-$Na_3PO_4$ was put into 710 parts by weight of deionized water, heated to 60° C. and stirred at 12000 rpm with a TK type homomixer (manufactured by TOKUSHU KIKA KOGYO CO., LTD.). An aqueous medium which contained $Ca_3(PO_4)_2$ was obtained by gradually adding 68 parts by weight of an aqueous solution of 0.1M-$CaCl_2$ to the aqueous solution of $Na_3PO_4$.

On the other hand,

| | |
|---|---|
| (monomers) styrene | 165 parts by weight |
| n-butyl acrylate | 35 parts by weight |
| (colorant) C.I. pigment blue 15:3 | 15 parts by weight |
| (charge controlling agent) metallic compound of salicyclic acid | 3 parts by weight |
| (polar resin) saturated polyester (acid value 14 mg KOH/g, peak molecular weight 8000) | 10 parts by weight |
| (release agent) ester wax | 30 parts by weight |

Materials listed above were heated to 60° C., and uniformly dissolved and dispersed using the TK type homomixer. By dissolving 10 parts by weight of polymerization initiator 2,2'-azobis(2,4-dimethylvaleronitrile) into the solution, a polymerizable monomer composition was prepared.

Granulation was conducted for approximately 10 minutes by introducing the polymerizable monomer composition described above while stirring the aqueous medium obtained above at 12,000 rpm with a TK type homomixer. The aqueous medium in which the polymerizable monomer composition was dispersed was polymerized for 10 hours at 60° C. in a nitrogen atmosphere while stirring it with a stirrer. After completing the polymerization reaction, residual monomers were removed under a reduced pressure, the composition was cooled, $Ca_3(PO_4)_2$ was dissolved by adding hydrochloric acid, and the composition was filtered, washed with water and dried, thereby obtaining cyanic color suspended particles.

A toner 2 was prepared by mixing 100 parts by weight of the color particles were mixed with 1.2 parts by weight of finely pulverized silica powder treated in a hydrophobic condition using the Henschel mixer. The toner 2 thus obtained had a weight average particle diameter (D4) of 6.8 μm, a number average particle diameter (Dl) of 5.0 μm, and shape factors SF-1 and SF-2 of 125 and 112, respectively.

TABLE 1

| | Coercive force (Oe) | Agglomeration degree (g/cm³) | Numeber average particle diameter (μm) | SF-1 | SF-2 | Agglomeration variation ratio between unexposed and exposed developers (%) |
|---|---|---|---|---|---|---|
| Carrier 1 | 89 | 2.02 | 30.2 | 115 | 106 | 0.9 |
| Carrier 2 | 89 | 2.10 | 30.2 | 115 | 106 | 0.5 |
| Carrier 3 | 89 | 1.75 | 30.2 | 115 | 106 | 9.7 |
| Carrier 4 | 89 | 1.80 | 30.2 | 115 | 106 | 6.7 |
| Carrier 5 | 241 | 2.22 | 29.4 | 119 | 108 | 0.5 |
| Carrier 6 | 520 | 2.59 | 28.9 | 120 | 110 | 0.7 |
| Carrier 7 | 81 | 2.08 | 30.0 | 127 | 115 | 0.6 |

TABLE 2

| | | | | Variation of toner concentration after reproduction of copies (wt %) | | | | | Image density | | | Unevenness in images at reproduction | Fog after reproduction |
|---|---|---|---|---|---|---|---|---|---|---|---|---|---|
| | Carrier No. | Toner No. | Developing sleeve No. | Initial stage | 1000 copies | 3000 copies | 10000 copies | 30000 copies | Initial stage | 3000 copies | 30000 copies | of 3000 copies | of 30000 copies |
| Example 1 | Carrier 1 | Toner 1 | Developing sleeve A | 7.9 | 8.1 | 7.8 | 7.7 | 7.8 | 1.51 | 1.53 | 1.51 | A | A |
| Example 2 | Carrier 2 | Toner 1 | Developing sleeve A | 8.0 | 8.2 | 7.9 | 7.6 | 7.7 | 1.47 | 1.52 | 1.49 | A | A |
| Example 3 | Carrier 5 | Toner 1 | Developing sleeve A | 7.8 | 8.0 | 8.1 | 8.5 | 8.6 | 1.50 | 1.53 | 1.48 | A | B |
| Example 4 | Carrier 7 | Toner 1 | Developing sleeve A | 7.9 | 7.9 | 8.2 | 8.3 | 8.0 | 1.49 | 1.40 | 1.39 | A | B |
| Example 5 | Carrier 1 | Toner 1 | Developing sleeve B | 7.8 | 7.9 | 8.1 | 8.1 | 7.8 | 1.52 | 1.48 | 1.44 | A | A |

TABLE 2-continued

| | Carrier No. | Toner No. | Developing sleeve No. | Variation of toner concentration after reproduction of copies (wt %) Initial stage | 1000 copies | 3000 copies | 10000 copies | 30000 copies | Image density Initial stage | 3000 copies | 30000 copies | Unevenness in images at reproduction of 3000 copies | Fog after reproduction of 30000 copies |
|---|---|---|---|---|---|---|---|---|---|---|---|---|---|
| Example 6 | Carrier 1 | Toner 1 | Developing sleeve C | 8.2 | 8.0 | 8.0 | 7.7 | 7.7 | 1.45 | 1.48 | 1.47 | B | A |
| Example 7 | Carrier 1 | Toner 2 | Developing sleeve A | 8.1 | 7.7 | 7.9 | 8.0 | 7.9 | 1.46 | 1.45 | 1.44 | A | A |
| Comparative Example 1 | Carrier 3 | Toner 1 | Developing sleeve A | 8.0 | 8.4 | 8.7 | 9.2 | 9.4 | 1.50 | 1.61 | 1.65 | A | B |
| Comparative Example 2 | Carrier 4 | Toner 1 | Developing sleeve A | 8.1 | 8.1 | 8.3 | 8.7 | 8.7 | 1.47 | 1.53 | 1.60 | A | B |
| Comparative Example 3 | Carrier 6 | Toner 1 | Developing sleeve A | 7.8 | 8.7 | 10.3 | 11.0 | 12.1 | 1.46 | 1.63 | 1.70 | A | C |

What is claimed is:

1. A developing method comprising the steps of:

stirring a two component-type developer for electrophotography which contains at least a toner and a carrier in a developer container with a stirring screw;

conveying said developer to a developing section with a conveying screw and a developer carrying member which has a structure rotating around an outer circumference of a fixed magnet core; and developing an electrostatic latent image formed on an image holding member by forming a magnetic brush on a developing magnetic pole at said developing section, wherein said carrier is a magnetic material dispersion-type resin carrier which contains at least a binder resin and a metal oxide, and has a coercive go force $H_c$ of 20 to 300 Oe, and said carrier has been previously exposed and magnetized in a magnetic field which is larger than a maximum value of an intensity of a vertical magnetic field on a surface of the developer carrying member, and said developer carrying member has a surface shape which satisfies the following conditions:

0.2 $\mu$m≦average roughness of centerline (Ra)≦5.0 $\mu$m,

10 $\mu$m≦average interval between concavity and convexity (Sm)≦80 $\mu$m, 0.03≦Ra/Sm≦0.5, wherein the reference symbol Ra represents an average roughness of centerline as measured in compliance with JIS-B0601 and the reference symbol Sm designates an average interval between concavity and convexity as measured in compliance with ISO 468.

2. The developing method according to claim 1, wherein the maximum value of the intensity of the vertical magnetic field on the surface of the developer carrying member is 0.5 to 2.0 kOe, and a relation between the intensity of the magnetic field to which the carrier is preliminarily exposed and the maximum value of the intensity of the vertical magnetic field on the surface of the developer carrying member satisfies the following condition:

$$1.0 < \frac{\text{Intensity of magnetic field to which carrier is exposed}}{\text{Maximum value of intensity of vertical magnetic field on surface of developer carrying member.}} \leq 10.0$$

3. The developing method according to claim 1, wherein said carrier has a coercive force $H_c$ of 20 to 100 Oe.

4. The developing method according to claim 1, wherein said carrier has a variation ratio of agglomeration degree between the stages before and after the exposure of the carrier for one minute to a parallel magnetic field having an intensity equal to the maximum value of the intensity of a vertical magnetic field on the surface of the developer carrying member, 5% or lower on the basis of the agglomeration degree before the exposure.

5. The developing method according to claim 1, wherein said carrier has a variation ratio of agglomeration degree between the stages before and after the exposure of the carrier for one minute to a parallel magnetic field having an intensity equal to the maximum value of the intensity of a vertical magnetic field on the surface of the developer carrying member, 3% or lower on the basis of the agglomeration degree before the exposure.

6. The developing method according to claim 1, wherein said carrier has a variation ratio of agglomeration degree between the stages before and after the exposure of the carrier for one minute to a parallel magnetic field having an intensity equal to the maximum value of the intensity of a vertical magnetic field on the surface of the developer carrying member, 2% or lower on the basis of the agglomeration degree before the exposure.

7. The developing method according to claim 1, wherein said carrier has a shape factor SF-1 of 100 to 140 and a shape factor SF-2 of 100 to 120.

8. The developing method according to claim 1, wherein said carrier has a shape factor SF-1 of 100 to 120 and a shape factor SF-2 of 100 to 110.

9. The developing method according to claim 1, wherein said carrier has a number average particle diameter of 5 to 50 $\mu$m.

10. The developing method according to claim 1, wherein said carrier is a resin-coated carrier composed of a carrier core material having a surface coated with a resin.

11. The developer according to claim 1, wherein said carrier contains 30 to 99% by weight of a metal oxide based on the weight of said carrier.

12. The developing method according to claim 1, wherein said metal oxide has magnetic characteristics of a coercive force of from 0 to 300 Oe, saturated magnetization of from 0 to 80 emu/g and residual magnetization of from 0 to 20 emu/g.

13. The developing method according to claim 1, wherein said carrier is produced by a polymerization method.

14. The developing method according to claim 1, wherein said binder resin is a phenol resin.

15. The developing method according to claim 1, wherein said conveying screw rotates at a peripheral speed ratio of 0.3 to 1.5 relative to said developer carrying member and has stirring blades arranged at a pitch of 10 to 30 mm.

16. The developing method according to claim 1, wherein said stirring screw has stirring blades arranged at a pitch of 10 to 30 mm and has stirring ribs which has an axial length of 20 to 90% relative to the pitch of the stirring blades.

17. The developing method according to claim 1, wherein said developer carrying member rotates in a direction to move said developer against the gravity in a developing area.

18. The developing method according to claim 1, wherein said developer carrying member rotates in a direction reverse to a rotating direction of an image holding member.

19. The developing method according to claim 1, wherein said maximum value of the intensity of the vertical magnetic field on the surface of the developer carrying member is 0.5 to 2.0 kOe.

* * * * *

UNITED STATES PATENT AND TRADEMARK OFFICE

CERTIFICATE OF CORRECTION

PATENT NO. : 6,083,655
DATED : July 4, 2000
INVENTOR(S) : Itabashi et al.

It is certified that error appears in the above-identified patent and that said Letters Patent is hereby corrected as shown below:

[56] References Cited

U.S. Patent Documents

Insert --5,439,771 8/95 Baba, et al. 430/106.06--.
Insert --5,464,720 11/95 Baba, et al. 430/122--.
Insert --5,712,069 1/98 Baba, et al. 430/106.6--.
Insert --5,576,133 11/96 Baba, et al. 430/106.6--.
Insert --5,766,814 6/98 Baba, et al. 430/106.6--.

Foreign Patent Documents

Insert --84-01837 05/1984 PCT--.

Column 1,
Line 31, "of," should read --of--.
Line 50, "density" should read --densities--.

Column 4,
Line 39, "use" should read --used--.

Column 5,
Line 29, "time" should read --times--.

Column 7,
Line 33, "( ∞f" should read --( ≃f--.

Column 15,
Line 3, "a" should read --an--.
Line 18, "particles" (second occurrence) should read -- particle--.

UNITED STATES PATENT AND TRADEMARK OFFICE

CERTIFICATE OF CORRECTION

PATENT NO. : 6,083,655
DATED : July 4, 2000
INVENTOR(S) : Itabashi et al.

It is certified that error appears in the above-identified patent and that said Letters Patent is hereby corrected as shown below:

Column 16,
Line 53, "of for going" should read --of the forgoing--.

Column 18,
Line 13, "in which" should read --which--.

Column 21,
Line 39, "go" should be deleted.

Column 24,
Line 1, "has" should read --have--.

Signed and Sealed this

Third Day of July, 2001

Nicholas P. Godici

*Attest:*

*Attesting Officer*

NICHOLAS P. GODICI
*Acting Director of the United States Patent and Trademark Office*